US006792697B2

(12) United States Patent
Wright et al.

(10) Patent No.: US 6,792,697 B2
(45) Date of Patent: Sep. 21, 2004

(54) FOOT PROTECTION KIT AND METHOD OF MAKING SAME

(75) Inventors: Clifford A. Wright, San Diego, CA (US); George D. Celmo, San Diego, CA (US)

(73) Assignee: Medical Device Group, Inc.

( * ) Notice: Subject to any disclaimer, the term of this patent is extended or adjusted under 35 U.S.C. 154(b) by 144 days.

(21) Appl. No.: 10/186,445

(22) Filed: Jul. 1, 2002

(65) Prior Publication Data

US 2004/0000070 A1 Jan. 1, 2004

(51) Int. Cl.[7] ..... A43B 3/12

(52) U.S. Cl. ..... 36/11.5; 36/9.4; 36/7.5; 12/142 S

(58) Field of Search ..... 36/11.5, 9.4, 25 R, 36/7.5, 94; 12/142 S

(56) References Cited

U.S. PATENT DOCUMENTS 4,030,212 A * 6/1977 Ito ..... 36/11.5
4,864,736 A * 9/1989 Bierk ..... 36/11.5
5,154,682 A * 10/1992 Kellerman ..... 36/44
5,615,496 A * 4/1997 Sharpstein ..... 36/11.5
5,659,979 A * 8/1997 Sileo ..... 36/54
5,737,853 A * 4/1998 Smejkal ..... 36/11.5
6,584,704 B2 * 7/2003 March ..... 36/7.1 R
6,640,465 B1 * 11/2003 Burgess ..... 36/11.5

* cited by examiner

*Primary Examiner*—Anthony D. Stashick
(74) *Attorney, Agent, or Firm*—Jerry R. Potts

(57) ABSTRACT

A foot protection kit includes a flat planar storage container for transporting and displaying a right foot protector and a left foot protector that are substantially identical in construction, each having a protuberance marker that facilitates proper footwear orientation. An instruction sheet is included in the kit for guiding a user relative to placing the right foot protector and the left foot protector in mirror image orientation so that they can be distinguished from one another for proper footwear orientation purposes. For assembly purposes after orienting the foot protectors in a mirror image orientation, the user lifts a foot hook portion of a foundation planar sheet upwardly from the sheet, bending it forward and away from a heel portion of the foot protector until the foot hook portion is parallel and slightly spaced apart from a platform area so that a slit in the foot hook portion is in alignment with a marker disposed in the platform area. The user then lifts a toe guard hook portion upwardly from the foundation sheet, bending it rearward a sufficient distance to allow its free terminal end to pass through the slit and releasing it into latching engagement with the foot hook portion to form a foot strap that holds the foot protector in engagement with the foot of the user.

20 Claims, 3 Drawing Sheets

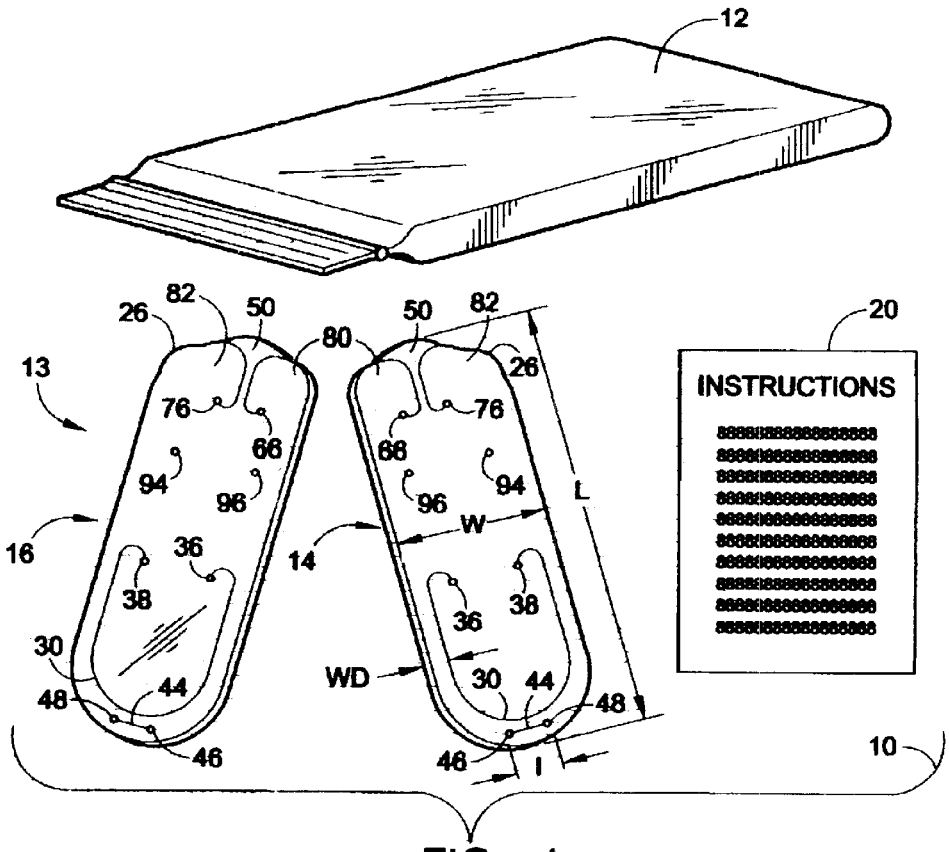
FIG. 1
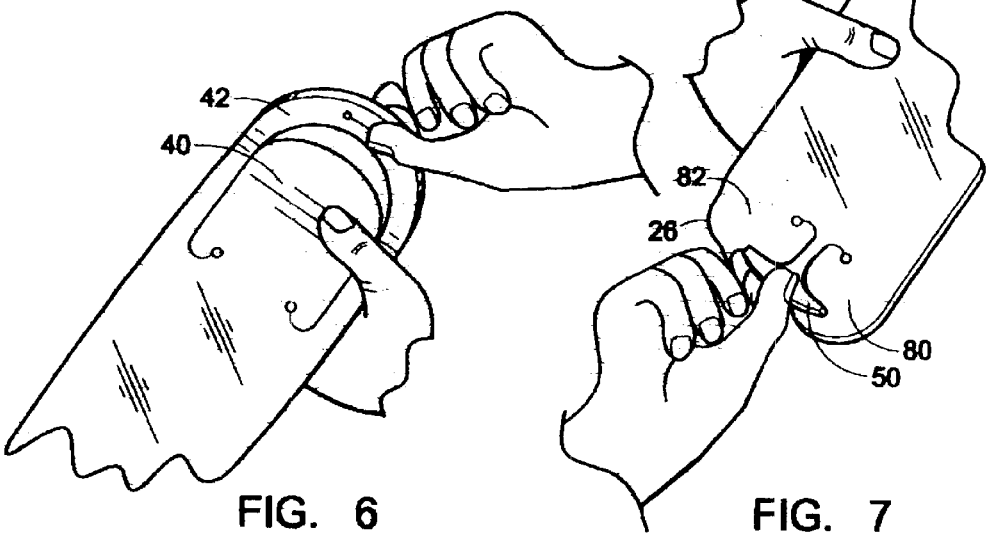
FIG. 6
FIG. 7

FOOT PROTECTION KIT AND METHOD OF MAKING SAME

TECHNICAL FIELD

The present invention relates to footwear and a method for constructing such footwear and more particularly to a foot protection kit and to a method for making and assembling the kit into a pair of disposable protective slippers.

BACKGROUND

The under portion of a person foot is tender and needs to be protected when walking on hot surfaces such as hot pavement or sand. Therefore it would be highly desirable to have a new and improved foot protection kit that can be easily and quickly assembled into a pair of disposable slippers in order to protect the feet of a user from sun heated ground surfaces, such as pavement or sand. Moreover, such a kit should be relatively inexpensive to manufacture and easily transportable by the user.

SUMMARY OF THE INVENTION

A foot protection kit includes a display package for holding a pair identical sheets of preformed and precut foam rubber. The identical sheets of foam rubber when removed from the display package can be easily and quickly assembled into protective footwear in accordance with a novel method of assembly. Each sheet is constructed of a thin sheet of pliable foam rubber of sufficient width and length to protect the under part of a persons foot and is specially precut during a novel manufacturing process to enable a user to orient the pair of sheets so they can be assembled into a right foot slipper and a left foot slipper. An identifying protuberance or marker is disposed near the upper outer periphery of each sheet to provide the user with an indication that a sheet has been properly positioned to be assembled into a right foot slipper when the protuberance is disposed on the right side of the sheet. Conversely, when the identifying protuberance or marker is positioned on the left side of the sheet, the protuberance provides the user with an indication that the sheet is ready to be assembled into a left foot slipper. In accordance with the assembly method of the present invention, a user attaches a top front portion of an individual one of the pair of preformed sheets to a top rear portion of the sheet to form a disposable slipper for the right foot of the user. The user then attaches a bottom front portion of the other individual one of the pair of preformed sheets to a bottom rear portion of the other individual one of the pair of preformed sheets to form a disposable left foot the user. The user then slips his or her feet into the pair of disposable slipper so that the feet of the user are protect from any sun heated ground surface. In this regard, the individual sheets of foam rubber are of sufficient thickness to prevent the transfer of heat from a sun-heated surface to the feet of user.

BRIEF DESCRIPTION OF THE DRAWINGS

The above mentioned features and steps of the invention and the manner of attaining them will become apparent, and the invention itself will be best understood by reference to the following description of the embodiments of the invention in conjunction with the accompanying drawings wherein:

FIG. 1 is a pictorial view, illustrating operative elements of a foot protection kit, which is constructed in accordance with the present invention;

FIG. 6 is a pictorial view of a slipper assembly step of separating the foot strap portion from a heel portion of the slipper of FIG. 2;

FIG. 7 is a pictorial view of another slipper assembly step of separating a strap hook portion from a toe portion of the slipper of FIG. 2.

BEST MODE FOR CARRYING OUT THE INVENTION

Figure 2:
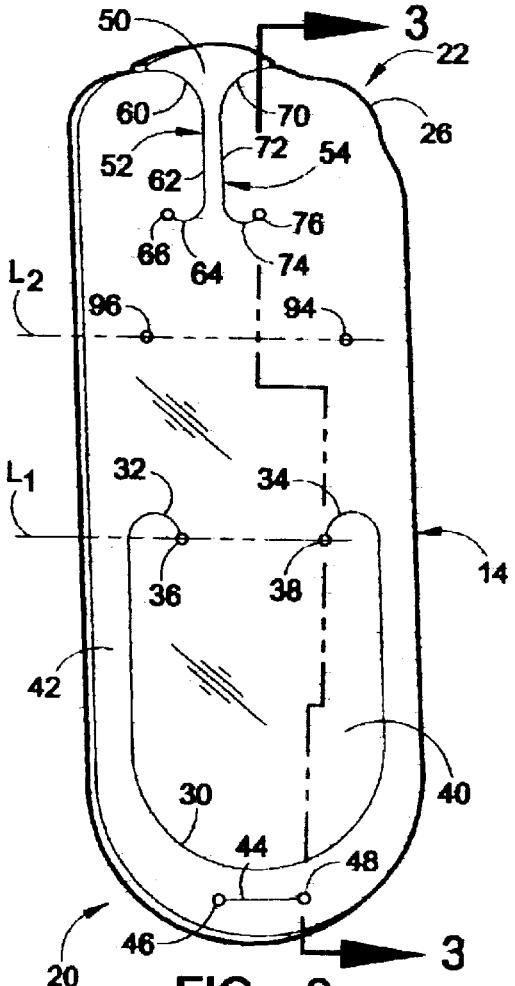
FIG. 2 is a pictorial view, of an unassembled right foot disposable slipper forming part of the foot protection kit of FIG. 1.

Referring now to the drawings, and more particularly to FIG. 1 thereof, there is shown a foot protection kit 10, which is constructed in accordance with the present invention. The kit 10 is assembled and used according to an assembly method of the present invention to help protect the feet of a user from sun heated ground surfaces. The kit 10 is further manufactured according to a manufacturing method that permits the kit to be manufactured in a relatively inexpensive manner.

Considering now the foot protection kit 10 in greater detail with reference to FIG. 1, the foot protection kit 10 is conveniently packaged for display purposes in a transparent resealable plastic bag 12 that has a sufficiently large interior to hold the various elements of the kit 10 which includes: a pair 13 of preformed and precut identical sheets of foot protection wear, such as a right foot slipper 14 and a left foot slipper 16, along with a set of instruction 20 that assist or guide a user relative to the assembly of the individual slippers. In this regard, by placing individual ones of the identically shaped sheets of foot protection wear in a mirror image orientation they may be assembled into a right foot slipper and a left foot slipper respectively as will be explained hereinafter in greater detail relative to the novel method of assembly of the present invention.

As mentioned earlier, the right foot slipper 14 is identical in construction to the left foot slipper 16 and can be easily and quickly oriented into a mirror image orientation, as best seen in FIG. 1, that permits a user to assembly them in accordance with the novel method of assembly into the right foot slipper 14 and the left foot slipper 16. Since the right foot slipper 14 and the left foot slipper 16 are substantially Identical in construction, only the right foot slipper 14 will be described hereinafter in greater detail.

Figure 3:
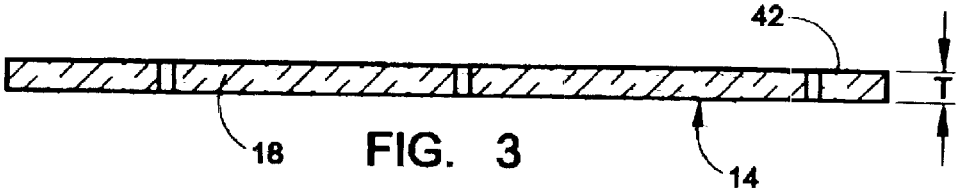
FIG. 3 is a cross sectional view taken substantially on line 3—3 of the right foot slipper of FIG. 2.

Considering now the right foot slipper 14 in greater detail with reference to FIGS. 2–5, the right foot slipper 14 is constructed of a flat sheet of a relatively soft and resilient material, such as foam rubber indicated generally at 18 (FIG. 3). The sheet 18 in the preferred embodiment of the present invention has sufficient width and length dimensions to support from below the foot of an adult user. In this regard the sheet 18 has a width dimension W of about five and one half inches and a length dimension L of about twelve inches. It is contemplated however, that width and length dimensions of greater and lesser values will be considered so that the footwear can be constructed to accomodate both large and small family members. The sheet 18 also has a sufficient thickness dimension T to prevent it from easily ripping or tearing when bent or when it engages small stones, pebbles and other debris encountered on a heated ground surface. In the preferred embodiment of the present invention, a preferred thickness T is about three eights of an inch. A more preferred thickness T is about one half an inch, and the most preferred thickness T is about five-eights of an inch.

As best seen in FIG. 2, the flat sheet 18 is precut and preformed into a desired footwear shape. In this regard, a rear portion 20 of the sheet 18 has a smooth semicircular or crescent shape while a front portion 22 of the sheet 18 has an irregular shape that includes a protuberance 26 that will be described hereinafter in greater detail. It will suffice to mention at the present moment that the protuberance 26 functions as an orientation marker so as to enable a user to orient the otherwise identical sheets into a mirror image orientation that thereby distinguishes the right foot slipper 14 from the left foot slipper 16 as will be explained hereinafter in greater detail.

Figure 4:
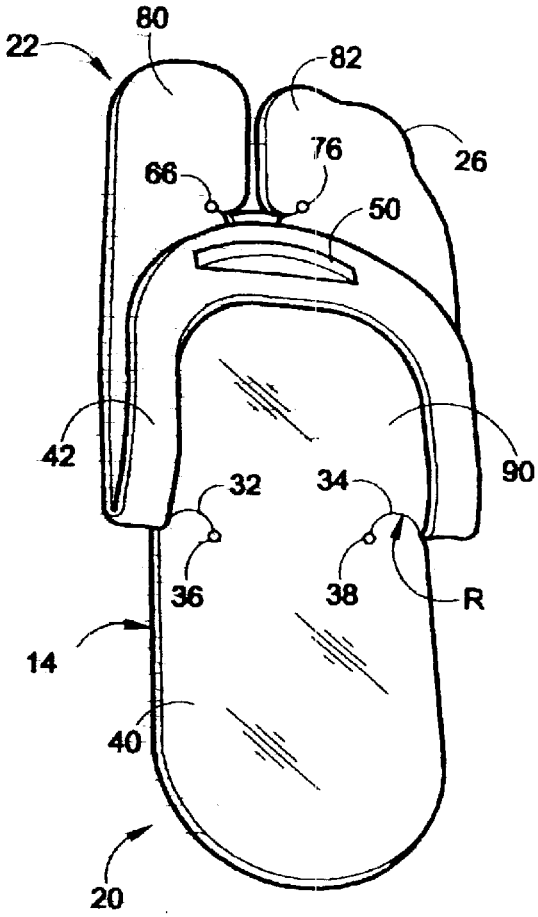
FIG. 4 is a pictorial view, of a right foot disposable slipper assembled from the right foot disposable slipper of FIG. 2.

The flat sheet 18 of foam rubber material is pre-cut to allow it to be bent and latched into a slipper shape as best seen in FIG. 4. In this regard, the sheet 18 is precut along a cut line 30 that is substantially identical in shape to the rear portion 20 of the sheet 18 but slightly inset from the outer edge thereof by about half an inch. The cut line 30 further extends along each lateral side of the sheet 18 toward the front portion 22 terminating in spaced apart arch or rear rip prevention portions 32 and 34 respectively. The arch portions 32 and 34 curve inwardly and away from the outer edges of the sheet 18 and then rearward terminating in rear rip prevention holes 36 and 38 respectively. The curved portions 32 and 34 cooperate with their respective rip prevention holes 36 and 38 to substantially prevent the sheet 18 from ripping or tearing when the sheet 18 is separated along the cut line 30 to form a heel portion 40 and a foot loop portion 42 of the slipper 14. Although in the preferred embodiment of the present invention the loop portion 42 is described as having a width dimension WD of about one half an inch it is contemplated that this width dimension WD can be greater or less ranging between about one eight of an inch to about two inches. Also in the preferred embodiment of the present invention, the curved portion 32 and 34 have a radius R of about one quarter inch, it is contemplated that other radii can be utilized ranging between about one sixteenth of an inch to about one half an inch.

As best seen in FIG. 2, adjacent the rear end of the foot loop portion 42, a slit 44 extends by about one inch in length 1 perpendicular to the longitudinal dimension of the sheet 18. The slit 44 as will be explained hereinafter in greater detail, functions as a latch that cooperates with a toe guard hook 50 forming part of the slipper 14. In order to prevent the slit 44 from ripping or tearing when engaged in its latching function with the toe guard hook 50, the slit 44 terminates at its opposite ends in a pair of latch rip prevention holes 46 and 48 respectively. The latch rip prevention holes 46 and 48 have a diameter of about one sixty-fourth of an inch.

The sheet 18 is also precut at its front portion 22 along a pair of cut lines 52 and 54 respectively. The cut line 52 is curved at a front portion 60 thereof to form a toe portion 80 (FIG. 4) of the slipper 14. The cut line 52 extends rearward into the sheet 18 in a straight portion 62 by about an inch and one half that runs parallel to the lateral sides of the sheet 18. The straight portion 62 terminates in a another curved portion 64 that curves outwardly toward the adjacent lateral side of the sheet 18 and then forwardly terminating in a front rip prevention hole 66. The curved portion 64 and the front rip prevention hole 66 cooperate to prevent the toe guard hook 50 from ripping away from the sheet 18 when it is bent and latched into engagement within the slit 44 as best seen in FIG. 4. It should be understood by those skilled in the are that by repeatedly bending the top guard hook 50 forward of the curved portion 64 of the cut line 52, that material 18 would tend to rip along this curved portion due to the repeated bending and the sheering forces generated against the toe guard hook 50 when it is disposed between the toes of a user. In this regard, the rip prevention hole 66 in combination with the curved portion 64 significantly reduces ripping of the material 18 beyond the cut line 52.

In a similar manner, the cut line 54 is curved at a front portion 70 thereof to form another toe portion 82 (FIG. 4) of the slipper 14. The cut line 54 and extends rearward into sheet 18 in a straight portion 72 by about an inch and one half that runs parallel to the lateral sides of the sheet 18. The straight portion 72 terminates in a another curved portion 74 that curves outwardly toward its adjacent lateral side of the sheet 18 and then forwardly terminating in another front rip prevention hole 76. The curved portion 74 and the front rip prevention hole 76 cooperate to prevent the toe guard hook 50 from ripping away from the sheet 18 when it is bent and latched into engagement within the slit 44 as will be explained hereinafter in greater detail.

From the foregoing it will be understood by those skilled in the art, that the sheet 18 forms a planar foot platform indicated generally at 90 that extends between the heel portion 40 and the toe portions 80 and 82 respectively. More particularly, the foot platform 90 extends between an imaginary line L1 extending through the rear rip prevention holes 36, 38 and another imaginary line L2 extending through the front rip prevention holes 66, 76 respectively. As will be explained hereinafter in greater detail, a pair of marker holes 94 and 96 respectively are disposed in the foot platform 90 are utilized as a guide in the assembly of the slipper 14 as will be explained hereinafter in greater detail.

As best seen in FIG. 2 the cut lines 52 and 54 cooperated to define the toe guard hook 50 that extends outward from the front portion of the slipper 14. The toe guard hook 50 is offset from the lateral center of the sheet 18 and cooperates with the protuberance 26 to enable the user to easily and quickly orient the identical sheets into a right foot orientation and a left foot orientation by placing the sheets adjacent one another in a mirror image orientation. In this regard the toe portion 80 is formed to support the big toe of a user while the toe portion 82 is formed to support the remaining toes of the user. In this manner, the slipper 14 can be worn in a comfortable manner with a stem portion 51 (FIG. 5) of the toe guard hook 50 disposed between the big toe and the adjacent toe of the user.

Considering now with reference to FIGS. 1, 5–7, the novel method of assembling the kit 10 into a right foot slipper 14 and a left foot slipper 16, the user opens the bag 12 and removes the pair 13 of identical planar sheets of footwear 14 and 16 respectively along with the instruction sheet 20. The user than reads the instruction sheet 20 which instructs the user to orient the footwear sheets 14 and 16 in a mirror image orientation as best seen in FIG. 1. Next, the user grasps the foot loop portion 42 and bends it forward and away from the heel portion 40 as best seen in FIG. 6 until it is parallel and slightly spaced apart from the platform 90 with the slit 44 in alignment with the marker holes 94 and 96 respectively. In this regard, the foot loop portion 42 is bent through about a 150-degree angle away from the heel portion 40.

Figure 5:
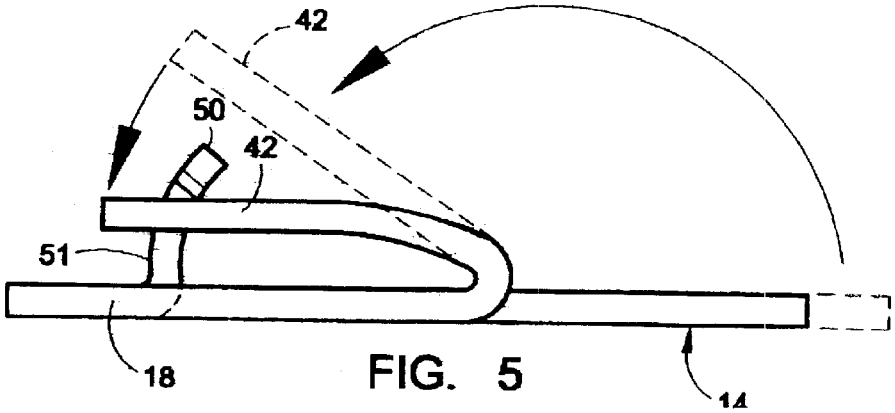
FIG. 5 is a side elevation view of the foot protector showing the forwardly bent position of a foot strap of FIG. 4.
Figure 8:
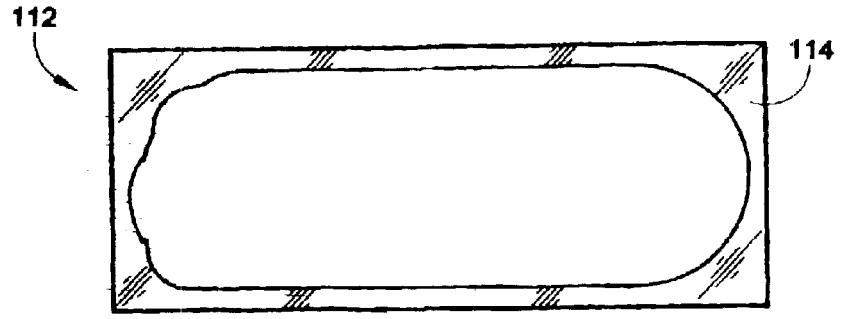
FIGS. 8–11 illustrate the steps of manufacturing a disposable slipper substantially similar to the disposable slipper of FIG. 2.
Figure 9:
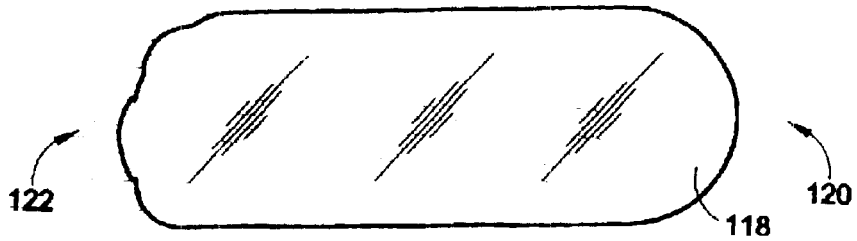
Figure 10:
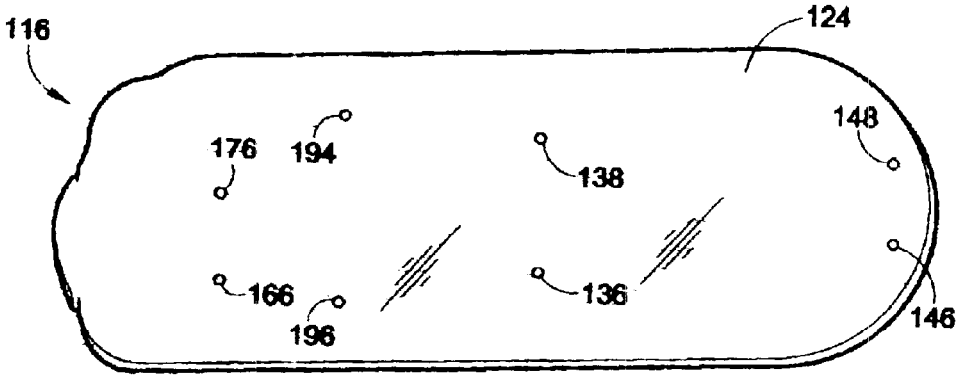

Next, as best seen in FIGS. 5 and 7, the user lifts and bends the toe guard hook 50 rearward a sufficient distance to allow its free terminal end to pass through the slit 44 to latch and engage the foot loop portion 42 and the toe guard hook 50 together to form a foot strap that will hold the slipper 14 in engagement with the right foot of the user. This process is then repeated utilizing the other sheet to form the left foot slipper. A user may then, with the slippers 14 and 16 secured to his or her feet, safely walk on sun heated ground surfaces without burning the soles of the feet. When the user has completed the use of the slippers 14 and 16, they may once again be stored in the bag 12 along with the instruction sheet 20 for later use. It will be recognized that the kit 10 can be easily stored and retrieved because of its flat planar nature.

Considering now the method of manufacturing a foot protector kit 10 in greater detail with reference to FIGS. 1 and 8–11, the method of manufacturing includes a sheet cutting step 112, wherein a flat sheet of sufficiently thick soft resilient material, such as a sheet of foam rubber 114, is cut into an elongated rectangular shaped sheet 118 having rounded end portions 120 and 122 respectively. In this regard, the resulting sheet 118 has a sufficient width W and length L dimensions for supporting from below the foot of a user.

Next, in a punching step 116, the sheet 118 is simultaneously punched with a set of foot hook rip preventing holes 136 and 138 respectively, a set of slit rip preventing holes 146 and 148 respectively, a set of toe guard hook rip preventing holes 166 and 176 respectively, and a set of alignment holes 194 and 196 respectively to form a punched sheet 124.

The punched sheet 124 is then processed in a cutting step 190 by cutting the punched sheet 124 along an interior rear cut line 130 disposed at rear end portion 120, where the interior rear cut line 130 terminates at its opposite ends in individual ones of the foot hook rip preventing holes 136 and 138 respectively. In this regard, the interior rear cut line 130 helps to define a heel portion 140 and a foot hook portion 142 of a newly formed foot protector FP.

Figure 11:
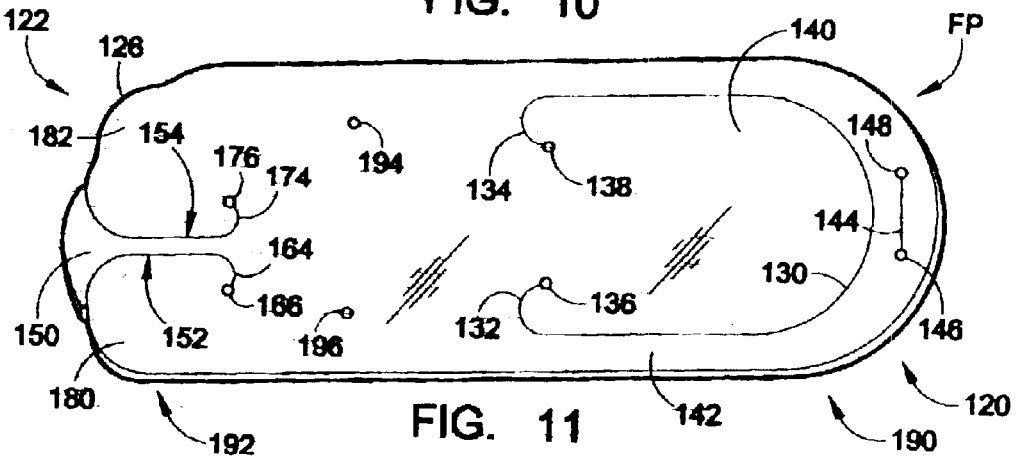

Simultaneously to cutting the punched sheet 124 along the interior rear cut line 130, the punched sheet 124 is further cut, during a cutting step 192, at its front end 122 to provide a pair of mirror image front cut lines 152 and 154 respectively. The cut lines 152 and 154 terminate in respective ones of the toe guard hook rip preventing holes 166 and 176. In this regard, the rip preventing holes 166 and 176 substantially prevent the foot protector FP from ripping at about the terminal ends of the front cut lines 152 and 154. As best seen in FIG. 11, the pair of mirror image front cut lines 152 and 154 help define a toe guard hook portion 150 and a pair of aced apart toe support areas 180 and 182 of a now completed foot protector, such as the foot protector FP as best seen in FIG. 11.

The above-mentioned steps of manufacturing the foot protector FP are repeated to form a second foot protector FP, where the foot protectors FP are substantially similar to foot protectors 14 and 16 as best seen in FIG. 1. Next, in a packaging step, the foot protectors 14 and the foot protector 16 are inserted into a transparent resealable plastic bag, such as the plastic bag 12, along with a set of instructions, such as the instruction sheet 20.

After the foot protectors 14, 16 and the instructions 20 have been inserted into the bag 12, a sealing step is performed to prevent the items within the bag 12 from accidentally spilling out. As a final step, the sealed bag 12 is a placed in a large shipping container (not shown) to facilitate shipping a given number of the foot protection kits, such as the foot protector kit 10, to a desired location.

With respect to the cutting step 112, it should be noted that this cutting step 112 includes cutting the outer periphery of one of said toe support areas 180 to provide this toe support area 180 with a protuberance marker 126. This protuberance marker 126 is utilized during the assembly process previously described.

Also with respect to the cutting step 190, it should be noted that the cut lines 152 and 154 a pair of arch line cuts 164 and 174 respectively, where the terminal ends of the line cuts 164 and 174 are in communication with the foot hook rip preventing holes 166 and 176 respectively.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

We claim:

1. A foot protection kit, comprising:

a storage container;

a sheet of assembly instructions; and a pair of identical unassembled protective slippers of substantially identical construction;

wherein each individual one of said pair of identical unassembled protective slippers includes:

a flat planar sheet of a soft resilient material having a width dimension of about five and one half inches, a length dimension of about twelve inches and a thickness of between about three eighths of an inch and about five eighths of an inch;

said flat planar sheet being punched with a set of rip prevention holes including a set of foot hook rip preventing holes, a set of slit rip preventing holes; a set of toe guard hook rip preventing holes; and a set of foot loop alignment holes;

said flat planar sheet having a front portion and a rear portion wherein said front portion has an irregular shape that includes an orientation marker protuberance and wherein said rear portion has a smooth semicircular shape outer edge;

said flat planar sheet further having a rear cut line substantially identical in shape to said rear portion but inset slightly from said outer edge to form a heel portion and a foot loop portion, said foot loop portion having a strap like configuration with a width dimension of between about one eighth of an inch and about two inches;

said rear cut line terminating at its opposite ends in mirror image rip prevention arches each having a radius of between about one sixteenth of an inch to about one half of an inch and wherein each individual arch is in communication with individual ones of the foot hook rip prevention holes in said set of foot hook rip prevention holes;

said foot loop portion having disposed therein a slit, wherein said slit has a length of about one inch and terminating at its opposite ends in individual ones of the slit rip preventing holes in said set of slit rip preventing holes, wherein said slip rip preventing holes have a diameter of between about one sixteenth of an inch and one eighth of an inch; and said flat planar sheet further having a pair of mirror image front cut lines extending inwardly from said front portion to form a pair of toe support platforms and a toe guard hook, said toe guard hook having sufficient width and length dimensions to engage and be latched releasably within said slit when said foot loop portion is separated from said heel portion and is bent forwardly into alignment with said a set of foot loop alignment holes and said toe guard hook is bent rearward into alignment with said set of foot loop alignment holes; and said sheet of instructions for guiding a user to place said pair of identical unassembled protective slippers of substantially identical construction in a mirror image orientation so that they can be distinguished from one another as a right foot protective slipper and a left foot protective slipper.

2. A foot protection kit, comprising:

a flat planar storage container having a sufficient interior volume for holding a pair of disposable slippers and a slipper assembly instruction sheet;

wherein said pair of disposable slippers is substantially identical in construction and yet distinguishable from one another when placed in a mirror image orientation;

wherein said pair of disposable slippers each include:

a flat planar sheet having a front portion with a right side toe platform and a left side toe platform, wherein one of toe platform has a greater length dimension that the other toe platform;

said flat planar sheet further having a back portion with a generally semi-circular rear edge terminating at its opposite ends in a pair of spaced apart straight edges;

said back portion having a rear cut line set inwardly of the outer boundary edges of said back portion, said rear cut line corresponding in shape to the outer boundary edges of said beck portion including a generally semicircular rear section terminating at its opposite ends in a pair of spaced apart straight line segments;

said rear cut line forming said back portion into a heel portion and a foot loop portion, said foot loop portion n having a strap like configuration with a uniform width dimension;

said foot loop portion having disposed therein a slit; and said flat planer sheet further having a pair of mirror image front cut lines extending inwardly from said front portion to form a pair of toe support platforms and a toe guard hook, said toe guard hook having sufficient width and length dimensions to engage and be latched releasably within said slit when said foot loop portion is separated from said heel portion and is bent forwardly and said toe guard hook is bent rearward into engagement with said foot loop portion.

3. A foot protection kit according to claim 2, wherein said flat planar storage container is a resealable storage container.

4. A foot protection kit according to claim 3, wherein said resealable storage container is a resealable plastic bag.

5. A foot protection kit according to claim 2, wherein said pair of disposable slippers includes:

a right foot protector and a left foot protector, wherein said right foot protector and said left foot protector are mirror images of one another.

6. A foot protection kit according to claim 5, wherein said right foot protector is a flat precut sheet of soft resilient material having a rear cut line terminating at its opposite ends in a material rip preventing arch and a rip prevention hole that cooperate with one another to substantially prevent said sheet from ripping at about the terminal ends of said rear cut line; and a pair of mirror image front cut lines including a right side cut line and a left side cut line for helping to define said toe guard hook and said toe support platforms;

each individual one of said pair of front cut lines terminating at its distal end in another material rip preventing arch and another rip prevention hole that cooperate with one another to substantially prevent said sheet from ripping at about the terminal end of the associated front cut line.

7. A foot protection kit according to claim 6, wherein said rear cut line facilitates defining a heel portion and a foot hook portion of said right foot protector; and wherein said rip prevention hole and said another rip prevention hole help define a foot platform area that is disposed between said holes.

8. A foot protection kit according to claim 7, wherein said foot platform area includes a marker for helping facilitate proper assembly of the right foot protector.

9. A foot protection kit according to claim 8, wherein said foot hook portion has a slit, said slit terminating at its opposite ends in slit rip prevention holes for substantially preventing said slit from ripping when said toe guard hook is latchingly engaged with said slit to form a right foot strap for securing said right foot protector to the right foot of a user.

10. A foot protection kit according to claim 9, wherein said right foot hook has a sufficient length to reach said foot platform area but not a sufficient length to reach said toe support areas.

11. A foot protector kit according to claim 10, wherein said toe support areas include at least one protuberance for helping to facilitate placement of said right foot protector and said left foot protector in said mirror image orientation so that they can be distinguished from one another for proper footwear orientation purposes.

12. The foot protector kit according to claim 2, wherein said flat planar sheet further has a plurality of rip prevention holes including a set of foot hook rip preventing holes, a set of slit rep preventing holes; and wherein said rear cut line terminates at its opposite ends in mirror image rip prevention arches and wherein each individual arch is in communication with individual ones of the foot hook rip prevention holes in said set of foot hook rip prevention holes.

13. The foot protector kit according to claim 12, wherein said silt terminates at its opposite ends in individual ones of the slit rip preventing holes in said set of slit rip preventing holes.

14. The foot protection kit according to claim 13, wherein said flat planar sheet further includes a set of foot loop alignment holes and a set of foot loop alignment holes to facilitate proper alignment of said toe guard hook with said slit so that said toe guard hook is in proper position to be latched releasably within said slit.

15. The foot protector kit according to claim 5, wherein said slipper assembly instructions includes a single sheet of instructions for guiding a user to place said right foot protector and said left foot protector in said mirror image orientation so that they can be distinguished from one another for proper footwear orientation purposes.

16. A foot protector kit, comprising:

a pair of mirror image sandals each having an intermediate section disposed between a front section, and a back section;

wherein said front section includes a pair of toe support platforms and a toe guard hook, said toe guard hook being defined by a pair of three segment cut lines;

each three segment cut line including an elongated straight section terminating at its opposite ends in an inwardly curved section and an outwardly curved section for helping to define an inner boundary edge of said toe guard hook;

wherein said back portion includes a heel portion and a foot loop portion, said heel portion and said foot loop portion being defined by a rear cut line; and said rear cut line including a generally semicircular rear section set inwardly of a corresponding semicircular segment defining an outer boundary edge of said back portion, said semicircular rear section terminating at its opposite ends in a pair of spaced apart straight line segments set inwardly of corresponding straight line segments defining another outer boundary edge of said back portion.

17. The foot protector kit according to claim 16, wherein said intermediate section is punched out for defining a pair of spaced apart alignment markers to help prevent ripping of said toe guard hook from said intermediate section when said toe guard hook is separated from said toe support platforms and is bent rearwardly into latching engagement with said foot loop and to help prevent ripping of said foot loop from said intermediate section when said foot loop is separated from said heel section and is bent rearwardly into latching engagement with said toe guard hook.

18. The foot protector kit according to claim 17, wherein one of said pair of toe support platforms includes an outwardly projecting protuberance for facilitating aligning said slippers in a mirror image orientation.

19. The foot protection kit according to claim 18, further comprising:

a sheet of assembly instructions; and a storage container having a sufficient volume for holding said pair of mirror image sandals and said sheet of assembly instructions.

20. The foot protection kit according to claim 18, wherein said sheet of assembly instructions includes a single sheet of instructions for guiding a user to place said pair of mirror image sandals in a mirror image orientation so that they can be distinguished from one another for proper footwear orientation purposes.

* * * * *